US008371556B2

(12) United States Patent
Price

(10) Patent No.: US 8,371,556 B2
(45) Date of Patent: Feb. 12, 2013

(54) MULTI-FUNCTION DECK TOOL

(76) Inventor: Daniel C Price, Cambridge, MD (US)

( * ) Notice: Subject to any disclaimer, the term of this patent is extended or adjusted under 35 U.S.C. 154(b) by 814 days.

(21) Appl. No.: 12/563,690

(22) Filed: Sep. 21, 2009

(65) Prior Publication Data

US 2011/0067528 A1 Mar. 24, 2011

(51) Int. Cl.
*B66F 3/00* (2006.01)

(52) U.S. Cl. ..... 254/17; 254/92; 254/98

(58) Field of Classification Search ..... 254/17, 254/92, 95, 98, 102, 126, 93 R
See application file for complete search history.

(56) References Cited

U.S. PATENT DOCUMENTS

| | | | | |
|---|---|---|---|---|
| 5,325,576 | A * | 7/1994 | Henderson | 29/426.5 |
| 5,478,050 | A * | 12/1995 | Ott | 254/17 |
| 6,233,899 | B1 * | 5/2001 | Mellert et al. | 52/747.1 |
| 6,971,635 | B1 * | 12/2005 | Foster | 254/17 |
| 7,431,266 | B1 * | 10/2008 | Evans | 254/30 |
| 7,857,287 | B2 * | 12/2010 | Rucks | 254/100 |
| 8,266,774 | B1 * | 9/2012 | Doty | 29/253 |
| 2007/0125991 | A1 * | 6/2007 | Mrugalski | 254/17 |

* cited by examiner

*Primary Examiner* — Lee D Wilson

(57) ABSTRACT

A multi-function deck tool is powered by a portable electric drill to remove old deck boards and nails and install new boards. Lifting forks remove deck boards. A built-in nail puller removes nails from the deck board supporting beam. An aligning arm attachment straightens and aligns new or loose boards with nailed-in boards and holds them in place, freeing the hands of the installer to nail in the new board.

10 Claims, 7 Drawing Sheets

MULTI-FUNCTION DECK TOOL

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to deck construction and particularly to a deck board remover and installation alignment tool which is actuated by a portable drill motor; the device comprises a drill motor attachment having a drill-actuated old board lifter, nail puller and new board straightening aligning, and holding clamp.

2. Description of Related Art Including Information Disclosed Under 37 CFR 1.97 and 1.98

Deck floors generally comprise of a series of boards laid side-by-side on top of and perpendicular to the support joists of the deck. The deck boards usually nailed to the joists. For safety and aesthetic purposes, deck boards need to be replaced when they deteriorate. The boards are usually removed with a pry bar. None of the prior art devices provide an electric drill powered device combining tools for removing old deck boards and nails and for aligning and holding a new deck board for installation.

U.S. Pat. No. 2,796,232, issued Jun. 18, 1957 to Steffanus, indicates a nail puller which is used with a hand drill. The nail puller comprises a two-part rotational body having an external anchor means, an internal nail-removing helix channel, a chuck-engaging shank, and a nail ejecting passage. The rotational force of the hand drill causes the nail to rise up through the helix channel and out through the ejection passageway.

U.S. Patent Application No. 20070175176, published Aug. 2, 2007 by Lane, describes a deck jig which comprises a decking board installation tool which keeps the space between the edges of the decking boards the same throughout the decking board installation.

U.S. Pat. No. 6,971,635, issued Dec. 6, 2005 to Foster, is for a deck board setting assembly which includes a bracket assembly having a channel therein for removably receiving an upper edge of a deck stud. The bracket assembly has a forward side and a rearward side. A pivot rod is rotatably coupled to and extends away from the bracket assembly. The pivot rod is orientated perpendicular to the channel. A lever assembly is pivotally attached to the pivot rod. The lever assembly is selectively rotated in a first direction forward of the bracket assembly or in a second direction rearward of the bracket assembly. A locking assembly is attached to the lever assembly and the bracket assembly for selectively preventing rotation of the lever assembly in the second direction. The lever assembly may be rotated in the first direction such that the lever assembly abuts a loose horizontal board and urges the loose horizontal board away from the bracket assembly.

U.S. Pat. No. 4,736,927, issued Apr. 12, 1988 to Clancy, provides a mechanical linear force actuator which is light weight and manipulatable and utilizes linear motion for push or pull forces while maintaining a constant overall length. The mechanical force producing mechanism comprises a linear actuator mechanism and a linear motion shaft mounted parallel to one another. The linear motion shaft is connected to a stationary or fixed housing and to a movable housing where the movable housing is mechanically actuated through actuator mechanism by either manual means or motor means. The housings are adapted to releasably receive a variety of jaw or pulling elements adapted for clamping or prying action. The stationary housing is adapted to be pivotally mounted to permit an angular position of the housing to allow the tool to adapt to skewed interfaces. The actuator mechanism is operated through a gear train to obtain linear motion of the actuator mechanism.

U.S. Pat. No. 6,015,136, issued Jan. 18, 2000 to Benudiz, shows a portable fastener removal apparatus for removing an elongate fastener having an axis of radial symmetry from a structure in which the fastener is embedded. The fastener removal apparatus is provided with a housing having an elongate channel which defines a housing axis. The housing is sized and configured to be positionable upon the structure such that the housing axis is coaxially aligned with the axis of radial symmetry. The fastener removal apparatus is further provided with a force transfer member which is movably attached to the housing and has an engagement portion which is concentrically positioned within the channel and formed to releasably engage the fastener. The fastener removal apparatus is further provided with a jack which is attached to the housing and has a force transmission member which is cooperatively engaged to the force transfer member and reciprocally movable along a lifting axis which extends in generally parallel relation to the housing axis. The actuation of the jack, subsequent to the engagement of the engagement portion to the fastener and positioning of the housing upon the structure, results in the movement of the force transmission member along the lifting axis in a direction away from the structure, thereby imparting a lifting force to the force transfer member which moves the engagement portion along the housing axis in a direction away from the structure, thus removing the fastener from therewithin.

U.S. Pat. No. 2,900,169, issued Aug. 18, 1959 to White, claims a power driven automatic bolt puller which includes a threaded shaft having attached thereto a collet for engaging a bolt head and a nut threadingly engaged on the shaft for urging the shaft through a barrel in the bolt puller, the nut being in the form of an elongated sleeve intended to receive the threaded portion of the bolt.

U.S. Pat. No. 1,094,449, issued Apr. 28, 1914 to Lauri, describes a floor clamping device that consists in a hand screw-secured, fined anchor which is joined by a threaded bolt to a turnbuckle coupler, which is in turn joined to a threaded bolt and then to a swivel mounted, plain rectangular head. The turnbuckle coupler is rotated by manipulation of a perpendicularly projecting handle that is placed in one of several holes girdling the turnbuckle coupler.

U.S. Pat. No. 3,152,787, issued Oct. 13, 1964 to Timmons, discloses a motorized floor jack which pulls floor boards into position and holds them until they are nailed. The device comprises a wheeled frame, a control box, a reversible electric motor, a threaded pulling shaft moved by the motor and a board pulling member attached to the distal shaft end by a chain.

U.S. Pat. No. 131,050, issued Sep. 3, 1872 to Butler, puts forth a spike extractor comprising a standing frame provided with a vertically oriented jack-screw which operates an upright claw-bar provided with a clutch of requisite form and dimension to grasp the head of a railroad spike.

What is needed is an electric drill powered device combining tools for removing old deck boards and nails and for straightening, aligning and holding a new deck board for installation.

BRIEF SUMMARY OF THE INVENTION

An object of the present invention is to provide a multiple arm tool powered by an electric drill combining tools for removing old deck boards and nails and for straightening, aligning and holding a new deck board for installation.

In brief, the invention is a mechanical apparatus with the main functions of removing decking planks from framing members, pulling out the nails left behind after removing the planks, and aiding in the installation of new decking planks by providing a means to force bent planks into position, straighten them, and hold them in place for fastening.

The tool is designed to incorporate all of these functions into one apparatus and is actuated by an ordinary power drill attached to the end of the shaft at the top of the tool. Much of the manual labor of removing old decking is eliminated, while speeding up the process and can easily be done from a standing position.

In the board-straightening mode, far more force can be applied and with much less effort than with any manually operated bending device, and provides a further advantage of holding the bent board in the desired position until released, leaving both hands free to fasten the board in place.

Replaceable lifting arms enables different arm sizes and different spacing between the two lifting arms to be used for different jobs.

A pair of pivotable lifting arms with individually pivotable arms enables the use of one or both lifting arms and enables the lifting arms to be pivoted up for storage.

The purpose of the device is to provide a multiple arm tool powered by an electric drill combining tools for removing old deck boards and nails and for aligning, straightening, and holding a new deck board for installation.

An advantage of the present invention is it provides an easy, mechanical means to remove old deck boards.

Another advantage of the present invention is it provides an easy, mechanical means to remove nails that remain after old deck boards are removed.

One more advantage of the present invention is it provides an easy, mechanical means to align, straighten, and hold new deck boards for installation.

An additional advantage of the present invention is it allows an installer to have both hands free to nail in a new deck board, as the device holds the board in place for the installer.

A further advantage of the present invention is that removed nails come out of the deck beams straight and ready to re-use.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
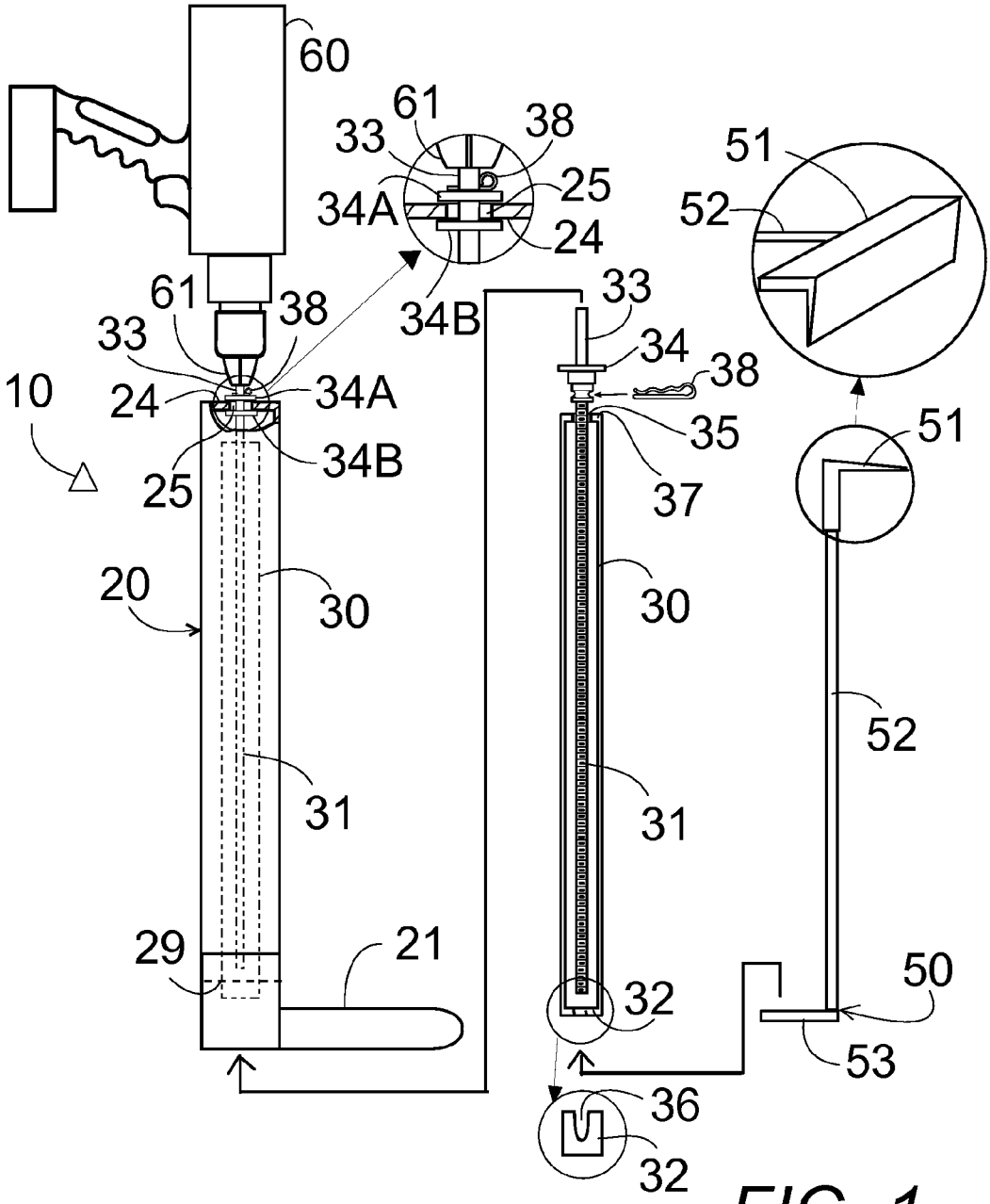
FIG. 1 is an exploded elevational view of the components of the multi-function deck tool of the present invention with the components separated.

In FIGS. 1-9, a multi-function deck tool 10 comprises an outer structural tube 20 having board lifting arms 21 to remove deck boards 71 from deck board support beams 70, an inner structural tube or piston 30 riding on a threaded shaft 31 having a nail receiving slot 36 for removing nails 72 from the beams 70, and an attachable aligning arm 50 for straightening, aligning, and holding new deck boards 71B to nail the boards to the beams.

Figure 2:
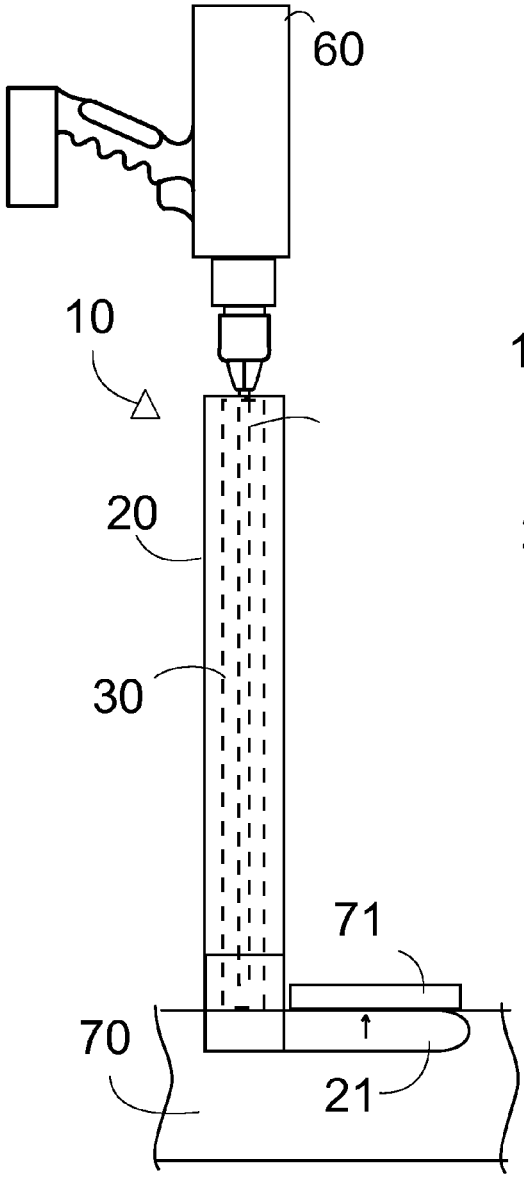
FIG. 2 is a side elevational view of the assembled multi-function deck tool of the present invention positioned with the lifting arms straddling a deck board support beam and positioned under the deck board for lifting the deck board showing a side view of the lifting arms.
Figure 3:
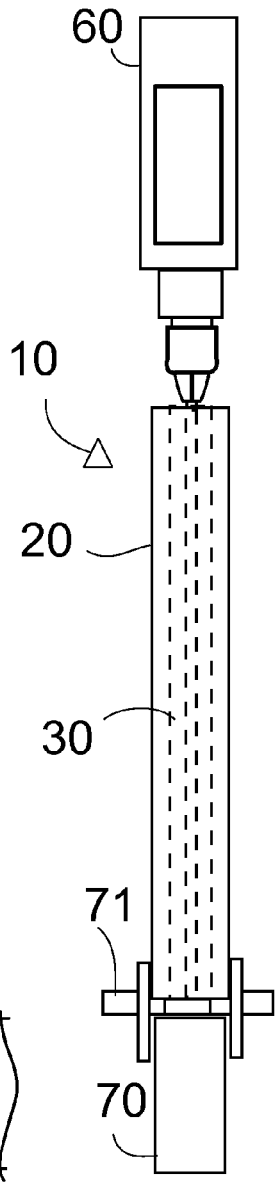
FIG. 3 is a rear elevational view of the assembled multi-function deck tool of FIG. 2 positioned with the lifting arms straddling a deck board support beam and positioned under the deck board for lifting the deck board showing an end view of the lifting arms.
Figure 4:
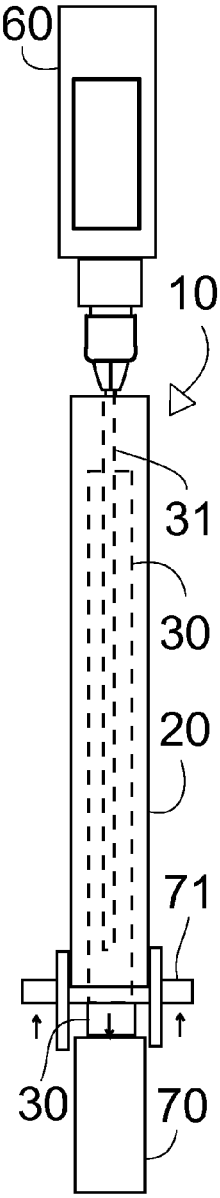
FIG. 4 is a rear elevational view of the assembled multi-function deck tool of FIG. 2 positioned with the lifting arms straddling a deck board support beam and shown lifting the deck board showing an end view of the lifting arms.

In FIGS. 1-9, the outer structural tube 20 comprises a rigid elongated hollow structure having a bottom open end 29 and an aperture 25 in a top end 24. A fork (also called rigid lifting arms) 21 extends down below the bottom open end 29 of the structural tube 20, as shown in FIG. 1. The fork 21 comprises a pair of parallel L-shaped spaced rigid board lifting arms permanently attached to a lower portion of the outer structural tube 20, extending below the bottom open end 29 and having two parallel lifting arms extending orthogonally relative to the outer structural tube 20 for lifting deck boards 71, as shown in FIGS. 2-4. The rigid board lifting arms 21 are spaced a sufficient distance apart to straddle a deck board supporting beam 70, as shown in FIGS. 3 and 4.

Figure 5:
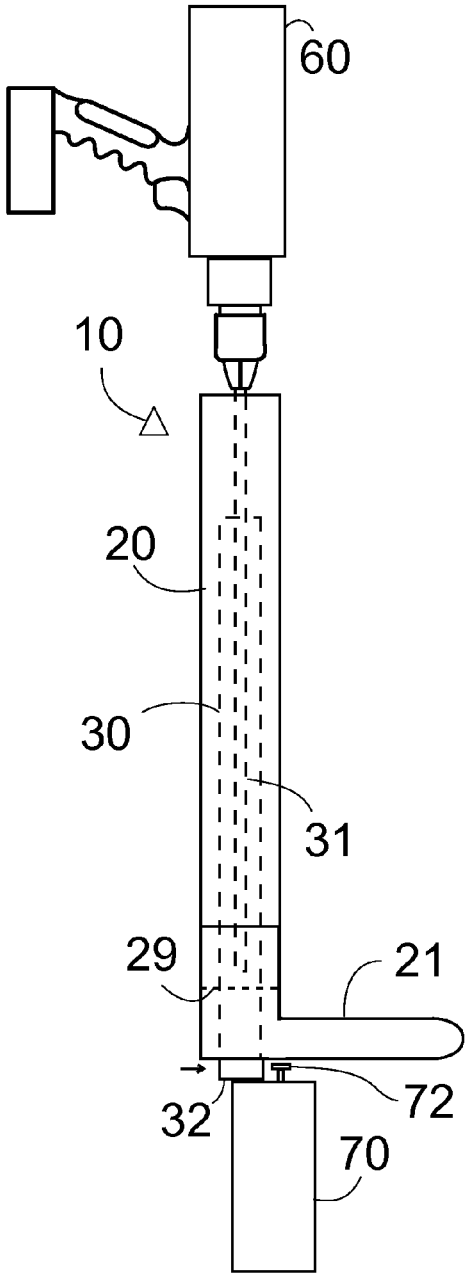
FIG. 5 is a side elevational view of the assembled multi-function deck tool of FIG. 2 positioned with the bottom flat head of the inner structural tube resting transversely on a deck board support beam showing the nail lifting flat head of the inner structural tube sliding toward a nail protruding from the deck board support beam to engage the nail in the nail slot.
Figure 6:
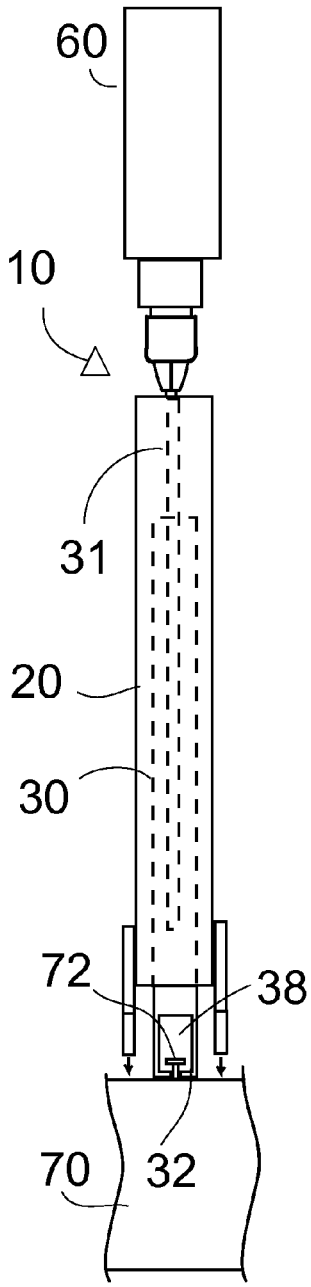
FIG. 6 is a front elevational view of the assembled multi-function deck tool of FIG. 2 positioned with the bottom flat head of the inner structural tube resting on a deck board support beam showing a front view of the nail lifting flat head of the inner structural tube with a nail in the nail slot.
Figure 7:
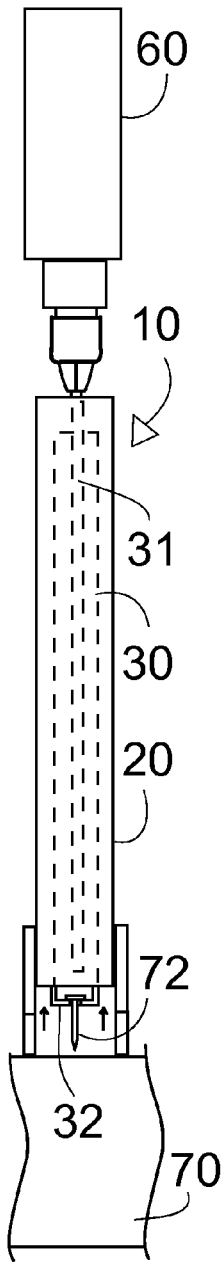
FIG. 7 is a front elevational view of the assembled multi-function deck tool of FIG. 2 positioned with the lifting arms straddling a deck board support beam and the bottom of the outer structural tube resting on a deck board support beam showing a front view of the nail lifting flat bottom of the inner structural tube lifting a nail in the nail slot to pull the nail from the beam.

In FIG. 1, an elongated threaded shaft 31 inside the inner structural tube 30 extends along the length of the outer structural tube 20. The inner structural tube 30 comprises a threaded opening 35 in a top inner shaft end 37 to ride on the threaded portion 31 of the threaded shaft inside the inner structural tube 30. A flat head 32 with a nail receiving slot 36 at the bottom end of the inner structural tube 30 pulls nails 72 from the deck board supporting beams 70 as shown in FIGS. 5-7. A drill bit engaging top portion 33 of the threaded shaft 31 extends out of the aperture 25 in the top end 24 of the outer structural tube 20 to be secured within a drill bit 61 of a drill 60 for rotating the threaded shaft reversibly by alternating the clockwise and counterclockwise rotation of the drill. A double thrust bearing 34A and 34B between the inner threaded portion 31 and the outer drill bit engaging portion 33 of the threaded shaft secures the threaded tube to the top end 24 of the outer structural tube 20 to permit rotation of the threaded shaft and prevent linear movement of the threaded shaft 31.

In FIGS. 1-9, the inner structural tube 30 comprises a rigid elongated hollow structure positioned slidably within the outer structural tube 20 between the threaded shaft 31 and the outer structural tube 20. The inner structural tube 30 is preferably the same square or other rectangular cross sectional shape as the outer structural tube 20 and slightly smaller so that the inner structural tube 30 slides within the outer structural tube but cannot rotate relative to the outer structural tube 20. The threaded opening 35 in the upper end 37 of the inner structural tube 20 engages the threaded shaft 31 so that rotation of the threaded shaft 31 causes linear movement of the inner tube 30 within the outer structural tube 20 along the threaded shaft 31 in one direction when the threaded shaft 31 is turned in a clockwise direction, and in an opposite direction when the threaded shaft 32 is turned in a counterclockwise direction.

In FIGS. 2-4, the flat head 32 at the lower end of the inner structural tube 30 engages the top of a deck board supporting beam 70 with the rigid lifting arms 21 spanning the deck beam 70 and positioned under a deck board 71. Activating the drill 60 in a direction to move the inner structural tube 30 downward causes the lifting arms 21 to lift the deck board 71 to remove it from the deck beam 70, as shown in FIG. 4.

In FIGS. 5-7, the inner structural tube 30 has at least one opening 38 (shown in FIG. 6) in a side wall adjacent to the flat head 32, with the flat head 32 having a nail receiving slot 36 (shown in FIG. 1) that extends from the opening in the side wall opening inwardly to a mid portion of the flat head 32 to receive a deck nail shaft 72 therein by sliding the flat head along the beam 70 to engage the nail, as shown in FIG. 5. The head of the nail shaft 72 rests on the inner surface of the flat head 32 with the nail shaft extending downwardly out of the flat head 32 through the nail receiving slot 36. In FIG. 7, the bottom of the lifting arms 21 rest transversely on a top surface of a deck beam 70 with the protruding deck nail 72 in the deck nail shaft. Activating the drill 60 attached to the drill bit end 33 of the inner structural tube 30 causes the inner structural tube 30 to rise up within the outer structural tube 20 to pull the deck nail 72 from the deck beam 70, as shown in FIG. 7, thereby providing a multi-function deck tool 10 for removing both deck boards 71 and deck nails 72.

Figure 8:
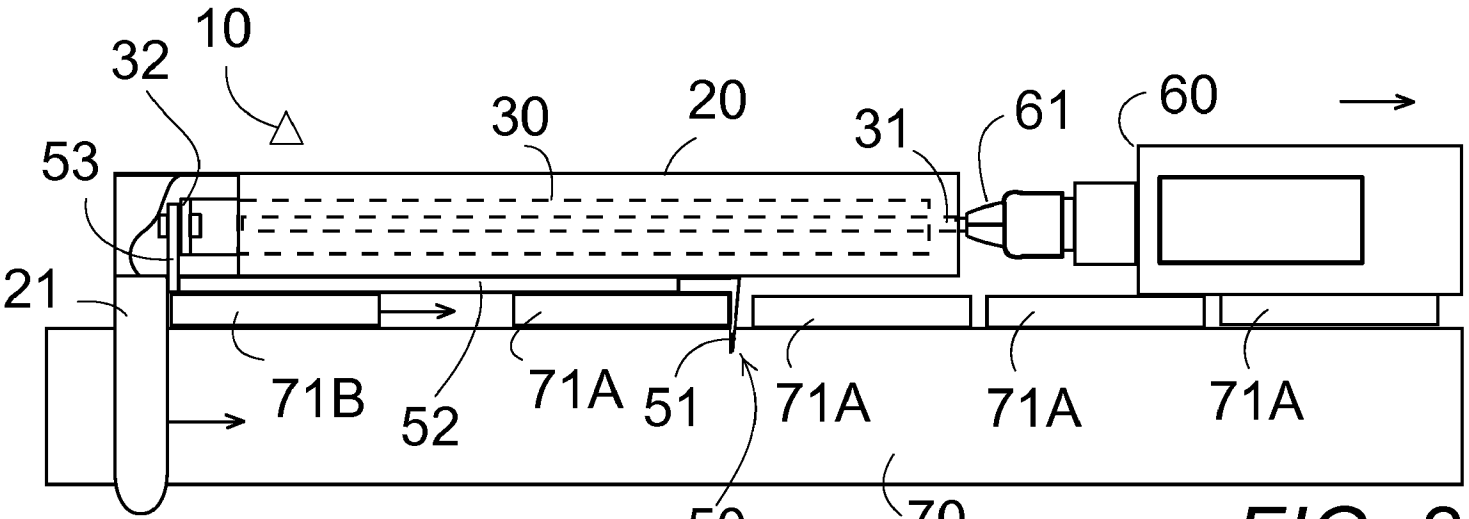
FIG. 8 is a side elevational view of the assembled multi-function deck tool of the present invention including the aligning arm attached to the flat end of the inner structural tube, with the multi-function deck tool positioned with the outer structural tube and drill oriented horizontally resting on the nailed deck boards, the lifting arms straddling a deck board support beam and hooked over an unattached deck board with an aligning plate of the aligning arm braced against a nailed deck board.
Figure 9:
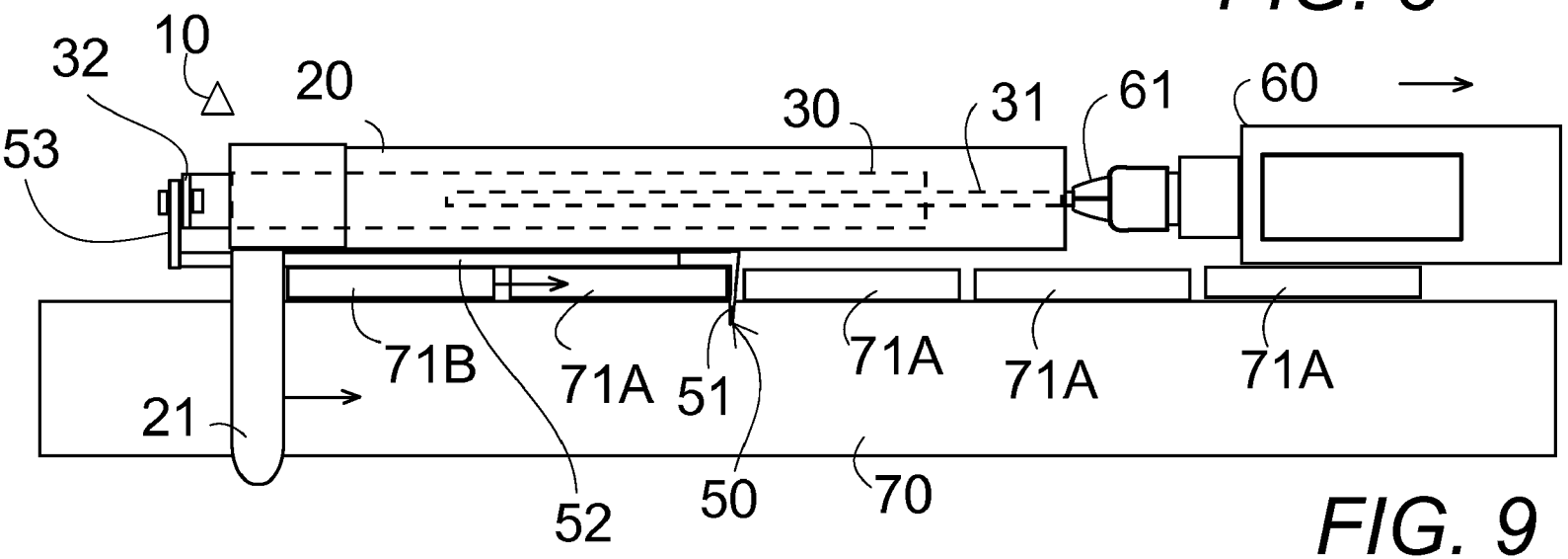
FIG. 9 is a side elevational view of the assembled multi-function deck tool of the present invention including the aligning arm attached to the flat end of the inner structural tube, with the multi-function deck tool positioned with the outer structural tube and drill oriented horizontally resting on the nailed deck boards, the lifting arms straddling a deck board support beam and hooked over an unattached deck board with an aligning plate of the aligning arm braced against a nailed deck board, showing the lifting arms straightening the unattached deck board and pulling it into alignment with the attached nailed deck board for attaching the unattached deck board to the beams.

In FIGS. 1, 8, and 9, the multi-function deck tool 10 further comprises an aligning arm 50 for use in combination with the multi-function deck tool 10 for straightening, aligning, and holding deck boards 71 for installation on the deck support beams 70. The aligning arm comprising an elongated rigid shaft 52, an attaching plate 53, and an aligning plate 51. The attaching plate 53 extends orthogonally from the rigid shaft 52 in a first direction at a first end of the rigid shaft 52, with the attaching plate 53 having an opening therethrough for removably attaching the attaching plate 53 to the bottom face of the flat head 32 of the inner structural tube 30 with a fastener removably engaged in the nail receiving slot 36 and the elongated rigid shaft 52 extending along an outer surface of the outer structural tube 20. The aligning plate 51 extends orthogonally from the rigid shaft 52 in a second opposite direction away from the rigid shaft 52 at a second end of the rigid shaft, the aligning plate 51 being positioned orthogonally to the outer structural tube 20 and parallel to the lifting arms 21. After positioning the aligning plate 51 against an inner edge of a previously nailed secure deck board 71A and hooking the lifting arms 21 over an outer edge of an unattached deck board 71B, turning the drill 60 causes the outer structural tube 20 to move to draw in the lifting arms 21 and pull in the unattached deck board 71B to straighten it and align it with the nailed secure deck board 71A. With the drill 60 stopped and the aligning plate 51 and lifting arms 21 acting like a vise, the aligning arm 50 holds the unattached deck board 71B in place in order to nail it to the deck support beams 70.

Figure 10:
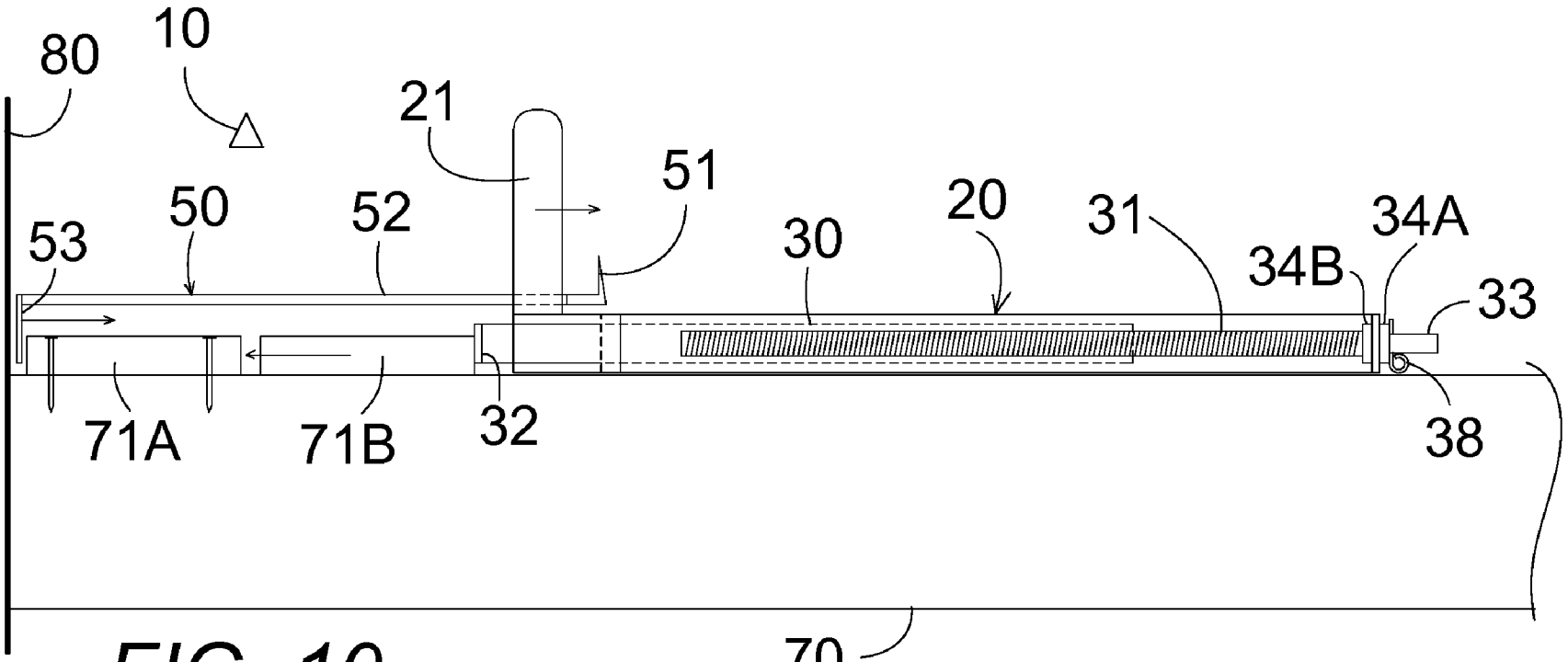
FIG. 10 is a side elevational view of the assembled multi-function deck tool of the present invention with the aligning arm reversed so that the aligning plate facing up is hooked between the lifting arms and the attaching plate facing down is hooked behind an attached deck nailed board adjacent to a building wall with the multi-function deck tool positioned with the outer structural tube and drill oriented horizontally on a deck board support beam and with the flat end of the inner structural tube pressing against an unattached deck board straightening the unattached deck board and pushing it into alignment with the attached nailed deck board for attaching the unattached deck board to the beams.
Figure 11:
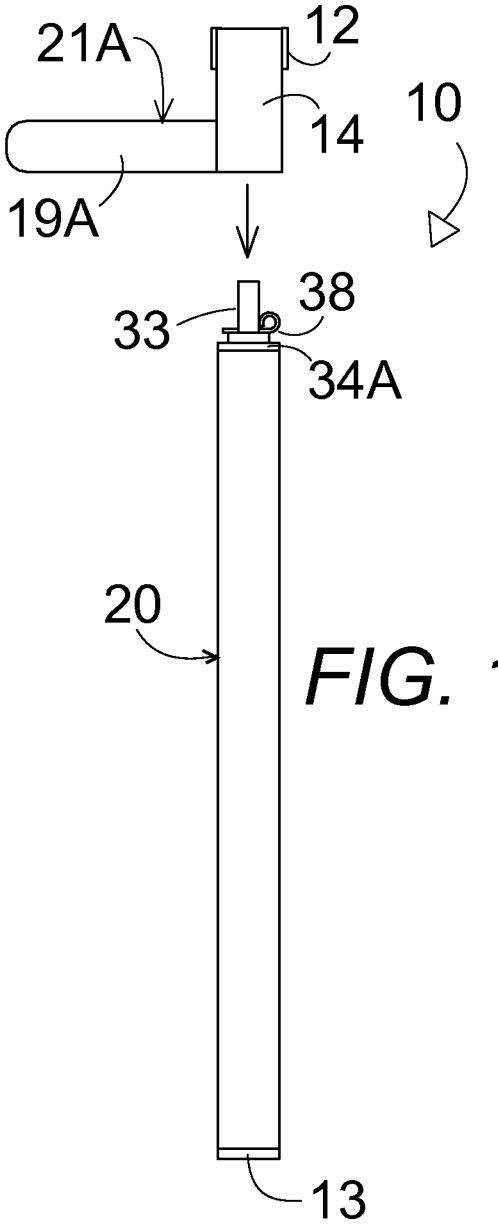
FIG. 11 is a side elevational view of the outer structural tube of the multi-function deck tool of the present invention held vertically and a replaceable lifting fork component with the lifting fork sleeve aligned for sliding down over the outer structural tube for assembly to enable different lifting arm sizes and different spacing between the two lifting arms to be used for different jobs.
Figure 12:
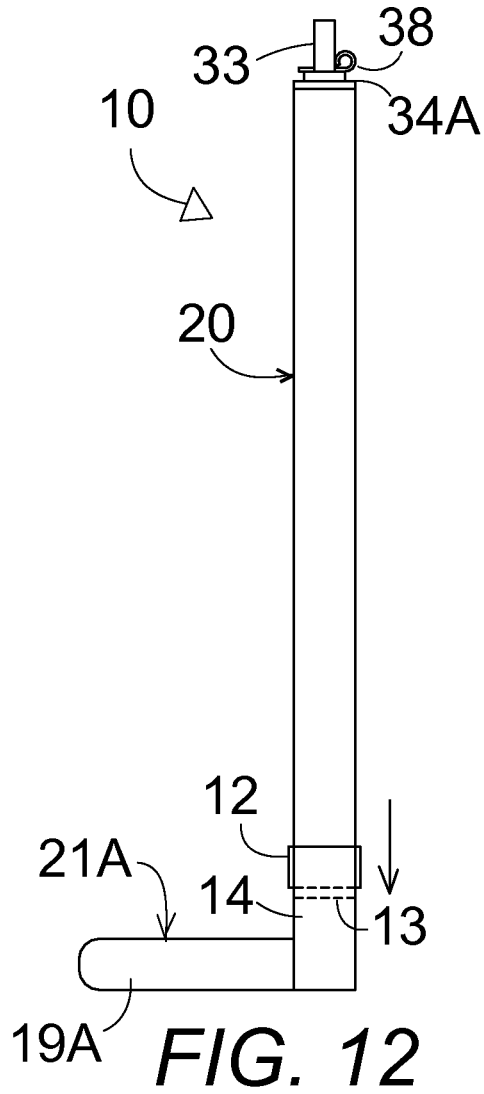
FIG. 12 is a side elevational view of the outer structural tube of the multi-function deck tool of FIG. 11 held vertically and the replaceable lifting fork component in place on the outer structural tube for use.

In FIG. 10, the elongated rigid shaft 52 has a width less that a space between the lifting arms 21 to fit between the lifting arms 21 and the aligning plate 51 has a width greater than the space between the lifting arms so the aligning plate 51 may be hooked facing up over the lifting arms 21 and the attaching plate 53 hooked facing down behind an attached nailed deck board 71A adjacent to a building wall 80 with the multi-function deck tool 10 positioned with the outer structural tube 20 and drill oriented horizontally on a deck board support beam 70 so that the flat end 32 of the inner structural tube 30 presses against an unattached deck board 71B straightening the unattached deck board and pushing it into alignment with the attached nailed deck board 71A for attaching the unattached deck board 71B to the deck board support beams 70.

In FIG. 1, the drill bit engaging top portion of the threaded shaft 33 may comprise a tapered end having three flattened sides for the jaws of the drill chuck 61 to grip better.

In FIG. 1, the double thrust bearing 34A and 34B on the threaded shaft is held in place in the upper aperture 25 of the top end 24 of the outer structural tube 20 with a clip/pin 38 to facilitate disassembly for cleaning, lubricating, repairs, and to change the orientation of the inner parts, such as to face the nail shaft in a different direction.

In FIGS. 1 and 5-7, the flat head 32 comprises a nail shaft 36 without square or tapered edges and no sloping surfaces to insure that the nail head remains captured without slipping out. The nail shaft 36 also terminates with a curved radius and not a sharp V point, so the shaft of the nail 72 is surrounded by the end of the nail shaft 36 and not jammed into a sharp corner that the nail could get stuck in. No sharp edge is required on the nail puller 32 and 36, as it is intended to place under nails that are already partially withdrawn. Nails pulled with this tool come out straight and are re-usable.

In FIGS. 1-9, the parts that form the board lifting arms 21 at the bottom are made to a length to accommodate the most popular width of deck boards which are 5½".

In use, the drill 60 is attached to the drill bit engaging top 33 extending out of a proximal end of the multi-function deck tool. The drill bit engaging top 33 is an extension of the inner threaded shaft 31 inside the outer tube 20. The drill 60 turns the drill bit engaging top 33 to turn the threaded shaft 31 and cause the inner structural tube 30 to move toward or away from the drill 60 depending on which direction the drill is turning.

In FIGS. 2-4, for lifting deck boards 71, the present invention board lifting tool uses the board lifting arms 21 built into the end of the outer tube 20 to lift nailed deck boards 71 from the deck board supporting beam 70. With the inner structural tube 21 straddling the beam 70 and hooked under the board 71 and the bottom flat head 32 of the inner structural tube 30 resting on the beam 70, turning the drill 60 causes the movement of the inner structural tube 30 away from the drill 60 so that the outer tube 20 and forks 21 move upward (since the beam 70 does not permit movement of the inner structural tube 30 resting against the beam 70) and the forks 21 lift the nailed board 71 to pull it up off of the deck board supporting beam 70 in order to remove the board.

In FIGS. 5-7, the bottom flat head 32 with the nail receiving slot 36 built into the distal end of the inner structural tube 30 pulls nails from beams as the inner structural tube 32 rises within the outer tube 20. The built-in nail puller hooks under a nail 72 protruding up from the beam 70 after ripping up the deck board 71. With the inner structural tube 21 resting on the beam 70, turning the drill 60 causes the movement of the inner piston 30 toward the drill 60 thereby pulling the nail 72 from the beam 70 so that the nail puller 32 moves upward, pulling the nail 72 from the beam 70, as in FIG. 7.

The board straightening and board aligning tool 50 with a wedge arm or aligning plate 51 is attached at one end of the multi-function deck tool, to the bottom flat head 32 built into the outer end of the inner structural tube 30, so that with the aligning plate 51 positioned against a nailed deck board 71A, the board lifting arms 21 at the end of the outer tube 20 move toward the board alignment plate 51 to draw in and straighten the loose board 71B to align it with the last nailed board 71A. The board lifting arms 21 moving back, along with the outer tube 20 and the drill 60, pull back on the loose deck board 71B while the aligning plate 51 stays in place on the nailed board 71A. The aligning tool 50 also holds the loose board 71B in place to nail it onto the beam 70.

Figure 13A:
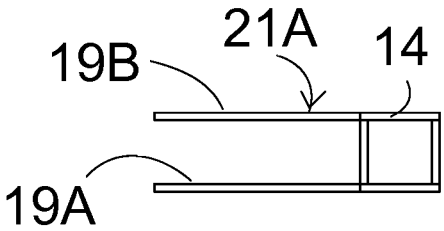
FIG. 13A is a top plan view of one size of replaceable lifting fork having the lifting arms spaced apart by the width of the lifting fork sleeve.
Figure 13B:
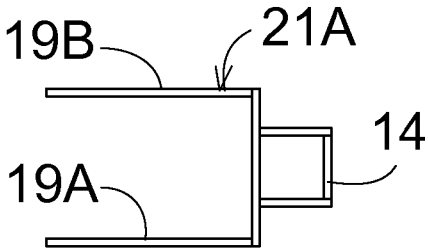
FIG. 13B is a top plan view of another size of replaceable lifting fork having the lifting arms spaced apart by a distance greater than the width of the lifting fork sleeve.

In FIGS. 11, 12, 13A and 13B, the lifting fork comprises a replaceable lifting fork 21A having a lifting fork sleeve 14 for sliding down over the outer structural tube 20 and the outer structural tube further comprises a sleeve stop 13 adjacent to a bottom of the outer structural tube for engaging a stop plate 12 on the lifting fork sleeve 14 to hold the replaceable lifting fork in place for use, to enable replacement of the lifting fork with different lifting arm sizes and different spacing between the lifting arms to be used for different jobs. In FIG. 13A, one size of replaceable lifting fork 21A has the lifting arms spaced apart by the width of the lifting fork sleeve 14. In FIG. 13B, another size of replaceable lifting fork 21A has the lifting arms 19A and 19B spaced apart by a distance greater than the width of the lifting fork sleeve 14.

Figure 14A:
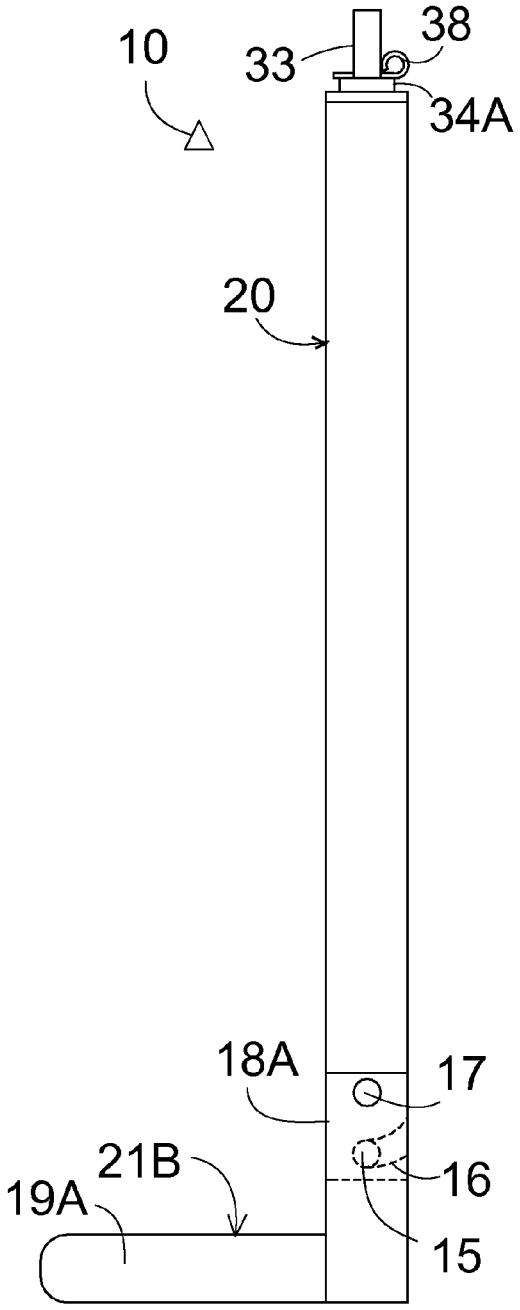
FIG. 14A is a side elevational view of the outer structural tube of the multi-function deck tool of the present invention having a lifting fork comprising a pair of pivotable lifting arms attached with individually pivotable lifting arms to enable the use of one or both lifting arms and enable the lifting arms to be pivoted up for storage, showing both pivotable arms pivoted down for use together.
Figure 14B:
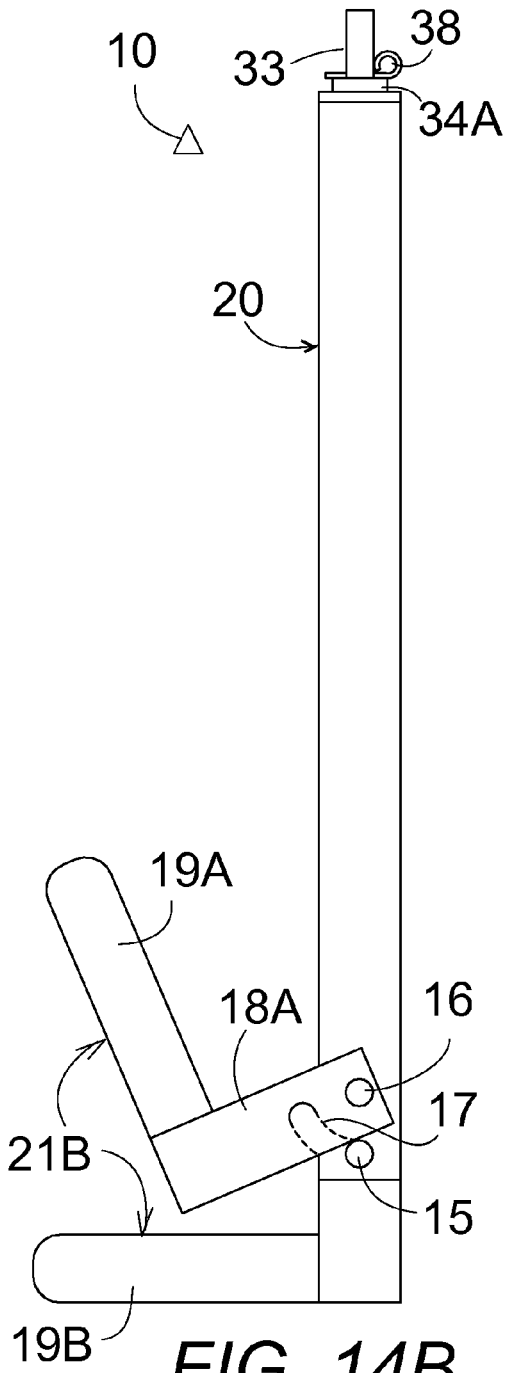
FIG. 14B is a side elevational view of the outer structural tube of the multi-function deck tool of FIG. 14A showing one of the pivotable arms pivoted partially up and the other pivoted down.

In FIGS. 14A and 14B the lifting fork 21B comprises a pair of pivotable lifting arms 19A and 19B attached to the outer structural tube 20 by attaching plates 18A and 18B each having a pivot pin 16 connecting it to the outer structural tube 20 and an arched slot 16 for engaging a protruding pin 15 from the outer structural tube 20 to enable the use of one lifting arm or both lifting arms and to enable the lifting arms to be pivoted up for storage. In FIG. 14A, both pivotable lifting arms 19A and 19B are pivoted down for use together. In FIG. 14B, one pivotable lifting arm 19A is pivoted partially up and the other pivotable lifting arm 19B is pivoted down.

It is understood that the preceding description is given merely by way of illustration and not in limitation of the invention and that various modifications may be made thereto without departing from the spirit of the invention as claimed.

What is claimed is:

1. A multi-function deck tool comprising:

an outer structural tube comprising a rigid elongated hollow structure having a bottom open end and an aperture in a top end; a fork extending down below a bottom of the structural tube, the fork comprising a pair of parallel L-shaped spaced rigid parallel lifting arms attached to a lower portion of the outer structural tube extending below the bottom opening, the lifting arms extending orthogonally relative to the outer structural tube for lifting deck boards, the lifting arms spaced apart a sufficient distance to straddle a deck board supporting beam;

an elongated threaded shaft inside the outer structural tube extending along the length of the outer structural tube, the threaded shaft comprising a threaded portion inside the outer structural tube, a drill bit engaging top portion of the threaded shaft extending out of the aperture in the top end of the outer structural tube to be secured within a drill bit of a drill for rotating the threaded shaft reversibly by alternating clockwise and counterclockwise rotation of the drill, and a double bearing between the inner threaded portion and the outer drill bit engaging portion of the threaded shaft, the double bearing secured within the aperture in the top end of the outer tube to permit rotation of the shaft and prevent linear movement of the shaft;

an inner structural tube comprising a rigid elongated hollow structure positioned slidable within the outer structural tube between the threaded shaft and the outer structural tube, a threaded opening in an upper end of the inner structural tube to engage the threaded shaft so that rotation of the threaded shaft causes linear movement of the inner tube within the outer structural tube along the threaded shaft in one direction when the threaded shaft is turned in a clockwise direction and in an opposite direction when the threaded shaft is turned in a counterclockwise direction; the inner structural tube further comprising a flat head at a lower end of the inner structural tube for engaging a top of a deck beam with the lifting arms spanning the deck beam and positioned under a deck board so that activating the drill in a direction to move the inner structural tube downward causes the lifting arms to lift the deck board to remove it from the deck beam; the inner structural tube having at least one opening in a side wall adjacent to the flat head, and the flat head having a nail receiving slot extending from the at least one opening in the side wall opening inwardly to a mid portion of the flat head to receive a deck nail shaft therein with a head of the nail shaft resting on an inner surface of the flat head and the nail shaft extending downwardly out of the flat head through the nail receiving slot so that resting a bottom of the lifting arms on a top surface of a deck beam with a protruding deck nail in the deck nail shaft and activating a drill attached to the drill bit end of the inner structural tube to cause the inner structural tube to rise up within the outer structural tube to pull the deck nail from the deck beam, thereby providing a multi-function deck tool for removing deck boards and removing deck nails.

2. The multi-function deck tool of claim 1 further comprising an aligning arm for use in combination with the multi-function deck tool for straightening and aligning deck boards for installation on the deck support beams, the aligning arm comprising an elongated rigid shaft, an attaching plate extending orthogonally from the rigid shaft in a first direction at a first end of the rigid shaft, the attaching plate having an opening therethrough for removably attaching the attaching plate to a bottom face of the flat head of the inner structural tube with a fastener removably engaged in the nail receiving slot and the elongated rigid shaft extending along an outer surface of the outer structural tube, and an aligning plate extending orthogonally from the rigid shaft in a second opposite direction away from the rigid shaft at a second end of the rigid shaft, the leverage plate positioned orthogonally to the outer structural tube and parallel to the lifting arms so that positioning the aligning plate against an inner edge of a previously nailed secure deck board and hooking the lifting arms over an outer edge of an unattached deck board, and turning the drill to cause the outer structural tube to move to draw in the lifting arms to pull in the unattached deck board to straighten the unattached deck board and align it with the nailed secure deck board and with the drill stopped to hold the unattached deck board in place to nail it to the deck support beams.

3. The multi-function deck tool of claim 2 wherein the elongated rigid shaft has a width less that a space between the lifting arms to fit between the lifting arms and the aligning plate has a width greater than the space between the lifting arms to hook the aligning plate facing up over the lifting arms and to hook the attaching plate facing down behind an attached nailed deck board adjacent to a building wall with the multi-function deck tool positioned with the outer structural tube and drill oriented horizontally on a deck board support beam so that the flat end of the inner structural tube presses against an unattached deck board straightening the unattached deck board and pushing it into alignment with the attached nailed deck board for attaching the unattached deck board to the deck board support beams.

4. The multi-function deck tool of claim 1 wherein the drill bit engaging top portion of the threaded shaft comprises a tapered end having three flattened sides for the jaws of the drill chuck to grip better.

5. The multi-function deck tool of claim 1 wherein the double bearing comprises a thrust bearing both above and below the top end of the inner structural tube to prevent linear movement of the threaded shaft while allowing rotation.

6. The multi-function deck tool of claim 1 wherein the threaded shaft is held in place with a clip/pin at the top to facilitate disassembly for cleaning, lubricating, repairs, and to change the orientation of the inner parts such as to face the nail shaft in a different direction.

7. The multi-function deck tool of claim 1 wherein the flat head comprises a nail shaft without square edges and no tapered edges and no sloping surfaces to insure that the nail head remains captured without slipping out.

8. The multi-function deck tool of claim 7 wherein the nail shaft terminates with a curved radius and not a sharp V point so the nail shaft is surrounded by the end of the nail shaft and not jammed into a sharp corner that the nail could get stuck in.

9. The multi-function deck tool of claim 1 wherein the lifting fork comprises a replaceable lifting fork having a lifting fork sleeve for sliding down over the outer structural tube and the outer structural tube further comprises a sleeve stop adjacent to a bottom of the outer structural tube for engaging the lifting fork sleeve to hold the replaceable lifting fork in place for use, to enable replacement of the lifting fork with different lifting arm sizes and different spacing between the lifting arms to be used for different jobs.

10. The multi-function deck tool of claim 1 wherein the lifting fork comprises a pair of pivotable lifting arms attached to the outer structural tube with individually pivotable lifting arms to enable the use of one pivotable lifting arm or both pivotably lifting arms and to enable the pivotable lifting arms to be pivoted up for storage.

* * * * *